US009835971B2

(12) United States Patent
Furuta et al.

(10) Patent No.: US 9,835,971 B2
(45) Date of Patent: Dec. 5, 2017

(54) IMAGE FORMING APPARATUS TO EMIT A PLURALITY OF LIGHT BEAMS FOR AN EXPOSURE OF A PHOTOSENSITIVE MEMBER

(71) Applicant: CANON KABUSHIKI KAISHA, Tokyo (JP)

(72) Inventors: Yasutomo Furuta, Abiko (JP); Hiroshi Nakahata, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/396,178

(22) PCT Filed: Apr. 22, 2013

(86) PCT No.: PCT/JP2013/002695

§ 371 (c)(1),
(2) Date: Oct. 22, 2014

(87) PCT Pub. No.: WO2013/161259

PCT Pub. Date: Oct. 31, 2013

(65) Prior Publication Data

US 2015/0130883 A1 May 14, 2015

(30) Foreign Application Priority Data

Apr. 24, 2012 (JP) ..... 2012-098682

(51) Int. Cl.
*G03G 15/043* (2006.01)

(52) U.S. Cl.
CPC ..... *G03G 15/043* (2013.01)

(58) Field of Classification Search
CPC ..... G03G 15/04; G03G 15/00; G03G 15/043; B41J 2/435; B41J 2/47; B41J 2/471; B41J 2/473; B41J 2/45; B41J 2/451; B41J 2/455
USPC ..... 347/229, 234, 235, 248–250
See application file for complete search history.

(56) References Cited

U.S. PATENT DOCUMENTS 5,576,852 A * 11/1996 Sawada ..... G02B 26/123 358/475
7,003,241 B1 * 2/2006 Kobayashi ..... B41J 2/473 250/205
8,553,061 B2 * 10/2013 Kudo ..... G02B 26/123 347/235

FOREIGN PATENT DOCUMENTS

| | | | |
|---|---|---|---|
| CN | 101266336 | A | 9/2008 |
| JP | 11-208023 | A | 8/1999 |
| JP | 2002-096502 | A | 4/2002 |
| JP | 2008-067449 | A | 3/2008 |
| JP | 2008-89695 | A | 4/2008 |
| JP | 2009-126110 | A | 6/2009 |
| JP | 2011-002499 | A | 1/2011 |

* cited by examiner

*Primary Examiner* — Geoffrey Mruk
*Assistant Examiner* — Scott A Richmond
(74) *Attorney, Agent, or Firm* — Canon USA, Inc., IP Division

(57) ABSTRACT

An image forming apparatus which is configured to expose a photosensitive member to light beams emitted from a plurality of light emitting elements, generates a plurality of BD signals by a plurality of laser light beams, and controls timings at which the plurality of light emitting elements emits the light beams based on a difference between timings at which the BD signals are generated.

12 Claims, 7 Drawing Sheets

[Fig. 3C]

IMAGE FORMING APPARATUS TO EMIT A PLURALITY OF LIGHT BEAMS FOR AN EXPOSURE OF A PHOTOSENSITIVE MEMBER

TECHNICAL FIELD

The present invention relates to an electrophotographic image forming apparatus including a light source configured to emit a plurality of light beams for an exposure of a photosensitive member.

BACKGROUND ART

Conventionally, there have been known image forming apparatuses configured to deflect a light beam emitted from a light source by a rotating polygonal mirror, and scan a photosensitive member by the light beam deflected by the rotating polygonal mirror, thereby forming an electrostatic latent image on the photosensitive member. Such image forming apparatuses include an optical sensor configured to detect the light beam deflected by the rotating polygonal mirror. The image forming apparatuses control the light source to emit the light beam therefrom based on a synchronization signal generated by the optical sensor, and match write start positions of electrostatic latent images (images) with each other in a direction in which the light beam scans the photosensitive member (a main scanning direction).

There are also known image forming apparatuses including a light source in which a plurality of light emitting elements configured to emit light beams is arranged as illustrated in FIG. 7A to increase an image forming speed and a resolution of an image. In FIG. 7A, an X-axis direction corresponds to the main scanning direction, and a Y-axis direction corresponds to a direction in which the photosensitive member rotates (a sub-scanning direction). In such image forming apparatuses, during an assembling process at a factory, the light source is rotated in a direction indicated by an arrow in FIG. 7A to adjust a distance between the light emitting elements in the Y-axis direction. By rotating the light source in this manner, a distance between exposure positions of the light beams emitted from the respective light emitting elements in the sub-scanning direction on the photosensitive member is adjusted to a distance corresponding to a resolution of the image forming apparatus.

The rotation of the light source in the direction indicated by the arrow illustrated in FIG. 7A changes both the distance between the light emitting elements in the Y-axis direction and the distance between the light emitting elements in the X-axis direction. Therefore, conventional image forming apparatuses cause each of the light emitting elements to emit a light beam at a timing determined for each of the light emitting elements based on the synchronization signal generated by the optical sensor to match the write start positions of electrostatic latent images with each other in the main scanning direction.

During the above-described assembling process, an angle by which the light source is rotated (an adjustment amount) varies for each image forming apparatus depending on how the light source is installed at the image forming apparatus and optical characteristics of optical members such as a lens and a mirror. Therefore, the distance between the light emitting elements in the X-axis direction after the rotational adjustment of the light source may not be the same among a plurality of image forming apparatuses. If a same timing is set for all image forming apparatuses as the light beam emission timing set for each light emitting element based on the synchronization signal generated by the optical sensor, this may result in generation of an image forming apparatus in which the write start positions of electrostatic latent images in the main scanning direction are out of alignment in the main scanning direction.

To prevent such misalignment among the write start positions of electrostatic latent images in the main scanning direction, which would be caused by rotating the light source during the assembling process, Japanese Patent Application Laid-Open No. 2008-89695 discusses an image forming apparatus that generates a plurality of horizontal synchronization signals by light beams respectively emitted from a first light emitting element and a second light emitting element, and sets a timing at which the second light emitting element emits a light beam relative to a timing at which the first light emitting element emits a light beam based on a difference between timings at which the plurality of horizontal synchronization signals is generated.

However, the image forming apparatus discussed in Japanese Patent Application Laid-Open No. 2008-89695 has the following issue. During image formation, heat is generated at a motor that drives a rotating polygonal mirror, and the temperature of a lens disposed near the rotating polygonal mirror increases due to the influence of the heat. The increase in the temperature of the lens causes a change in the optical characteristics of the lens such as a refractive index of a light beam in the main scanning direction. The change in the optical characteristics of the lens causes a change in a relative positional relationship among image forming positions of a plurality of light beams on a photosensitive member, like a change from a state illustrated in FIG. 7B to a state illustrated in FIG. 7C (or from FIG. 7C to FIG. 7B). With the change in the optical characteristics and the change in the relative positional relationship among the image forming positions of the plurality of light beams on the photosensitive member during image formation in this manner, a misalignment occurs among write start positions of electrostatic latent images formed by the light beams emitted from the respective light emitting elements.

CITATION LIST

Patent Literature

PTL 1: Japanese Patent Application Laid-Open No. 2008-89695

SUMMARY OF INVENTION

According to an aspect of the present invention, an image forming apparatus includes a photosensitive member configured to rotate, an optical scanning device including a light source including a plurality of light emitting elements including a first light emitting element configured to emit a first light beam and a second light emitting element configured to emit a second light beam for exposing the photosensitive member, a deflection unit configured to deflect a plurality of light beams emitted from the light source to cause the plurality of light beams to scan the photosensitive member, and a lens configured to guide the plurality of light beams deflected by the deflection unit to the photosensitive member, wherein the first light emitting element and the second light emitting element are disposed at the light source in such a manner that the first light beam and the second light beam expose different positions in a scanning direction in which the first light beam and the second light beam deflected by the deflection unit scan the photosensitive member, a detection unit configured to detect the first light beam and the second light beam deflected by the deflection unit, a storage unit configured to store predetermined data, wherein the predetermined data relates to a detection timing difference between the first light beam and the second light beam detected by the detection unit, and a control unit configured to control a timing at which the second light emitting element emits the second light beam relative to a timing at which the first light emitting element emits the first light beam for forming an electrostatic latent image on the photosensitive member based on a comparison result of a comparison between the detection timing difference between the first light beam and the second light beam detected by the detection unit and the predetermined data.

Further features of the present invention will become apparent from the following description of exemplary embodiments with reference to the attached drawings.

BRIEF DESCRIPTION OF DRAWINGS

The accompanying drawings, which are incorporated in and constitute a part of the specification, illustrate exemplary embodiments, features, and aspects of the invention and, together with the description, serve to explain the principles of the invention.

FIG. 3C schematically illustrates a beam detector (BD).

DESCRIPTION OF EMBODIMENTS

Various exemplary embodiments, features, and aspects of the invention will be described in detail below with reference to the drawings.

Figure 1:
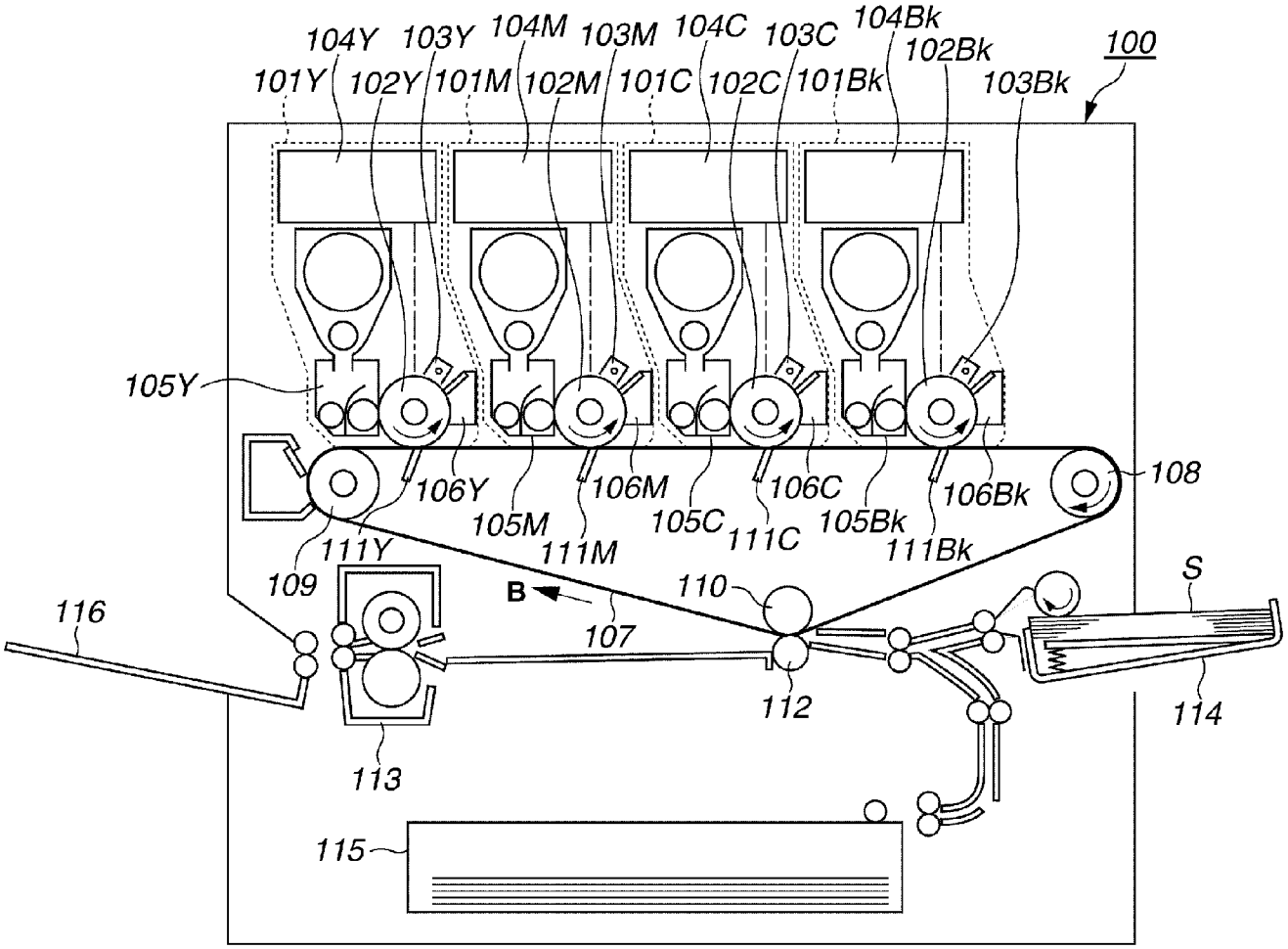
FIG. 1 is a schematic cross-sectional view of a color image forming apparatus.

FIG. 1 is a schematic cross-sectional view illustrating a digital full color printer (a color image forming apparatus) capable of forming an image using toners of a plurality of colors according to a first exemplary embodiment. The present exemplary embodiment will be described based on an example of a color image forming apparatus. However, the present invention does not necessarily have to be embodied by a color image forming apparatus, and may be embodied by an image forming apparatus capable of forming an image using a toner of a single color (for example, black).

First, an image forming apparatus 100 according to the present exemplary embodiment will be described with reference to FIG. 1. The image forming apparatus 100 includes four image forming units 101Y, 101M, 101 C, and 101Bk, each of which forms an image for each color. The indices Y, M, C, and Bk used herein indicate yellow, magenta, cyan, and black, respectively. That is, the image forming units 101Y, 101M, 101C, and 101Bk respectively form images using a yellow toner, a magenta toner, a cyan toner, and a black toner.

The image forming units 101Y, 101M, 101C, and 101Bk respectively include photosensitive drums 102Y, 102M, 102C, and 102Bk which are photosensitive members. Charging devices 103Y, 103M, 103C, and 103Bk, optical scanning devices 104Y, 104M, 104C, and 104Bk, and developing devices 105Y, 105M, 105C, and 105Bk are disposed around the photosensitive drums 102Y, 102M, 102C, and 102Bk, respectively. Further, drum cleaning devices 106Y, 106M, 106C, and 106Bk are disposed around the photosensitive drums 102Y, 102M, 102C, and 102Bk, respectively.

An intermediate transfer belt 107 which is an endless belt is disposed below the photosensitive drums 102Y, 102M, 102C, and 102Bk. The intermediate transfer belt 107 is stretched around a driving roller 108 and driven rollers 109 and 110, and rotates in a direction indicated by an arrow B illustrated in FIG. 1 during image formation. Further, primary transfer devices 111Y, 111M, 111C, and 111Bk are disposed at positions respectively facing to the photosensitive drums 102Y, 102M, 102C, and 102Bk via the intermediate transfer belt 107 (an intermediate transfer member).

The image forming apparatus 100 according to the present exemplary embodiment further includes a secondary transfer device 112 for transferring a toner image on the intermediate transfer belt 107 to a recording medium S, and a fixing device 113 for fixing the toner image on the recording medium S.

An image forming process from a charging process to a developing process at the thus-configured image forming apparatus 100 will be described. The respective image forming units 101Y, 101M, 101C, and 101Bk perform the image forming process in similar manners. Therefore, the image forming process will be described focusing on the image forming unit 101Y as an example, and the descriptions of the image forming processes at the image forming units 101M, 101C, and 101Bk are omitted herein.

First, the rotatably driven photosensitive drum 102Y is charged by the charging device 103Y of the image forming unit 101Y. The charged photosensitive drum 102Y (a surface of an image bearing member) is exposed by laser light beams emitted from the optical scanning device 104Y. Accordingly, an electrostatic latent image is formed on the rotating photosensitive drum 102Y. Then, the electrostatic latent image is developed as a yellow toner image by the developing device 105Y.

Hereinbelow, the image forming process from a transfer process and subsequent processes will be described based on an example of the image forming units 101Y, 101M, 101C, and 101Bk. The primary transfer devices 111Y, 111M, 111C, and 111Bk apply transfer biases to the intermediate transfer belt 107 to transfer yellow, magenta, cyan, and black toner images formed on the photosensitive drums 102Y, 102M, 102C, and 102Bk of the respective image forming units 101Y, 101M, 101C, and 101Bk onto the intermediate transfer belt 107. Accordingly, the toner images of the respective colors are superimposed on one another on the intermediate transfer belt 107.

After the four-color toner image is transferred onto the intermediate transfer belt 107, the four-color toner image transferred onto the intermediate transfer belt 107 is transferred again (secondary transfer) by the secondary transfer device 112 onto the recording medium S which is conveyed from a manual sheet feeding cassette 114 or a sheet feeding cassette 115 to a secondary transfer portion T2. Then, the toner image on the recording medium S is heated and fixed at the fixing device 113. The recording medium S is discharged to a sheet discharge portion 116, and thus, a full color image can be provided on the recording medium S.

After the transfer, residual toner is removed from the respective photosensitive drums 102Y, 102M, 102C, and 102Bk by the drum cleaning devices 106Y, 106M, 106C, and 106Bk. Then, the above-described image forming process is continuously repeated.

Next, the configurations of the optical scanning devices 104Y, 104M, 104C, and 104Bk which are exposure units will be described with reference to FIGS. 2A, 2B, 3A, 3B, and 3C. Since the respective optical scanning devices 104Y, 104M, 104C, and 104Bk are identically configured, the indices Y, M, C, and Bk, which indicate the colors, are omitted in the following descriptions.

Figure 2A:
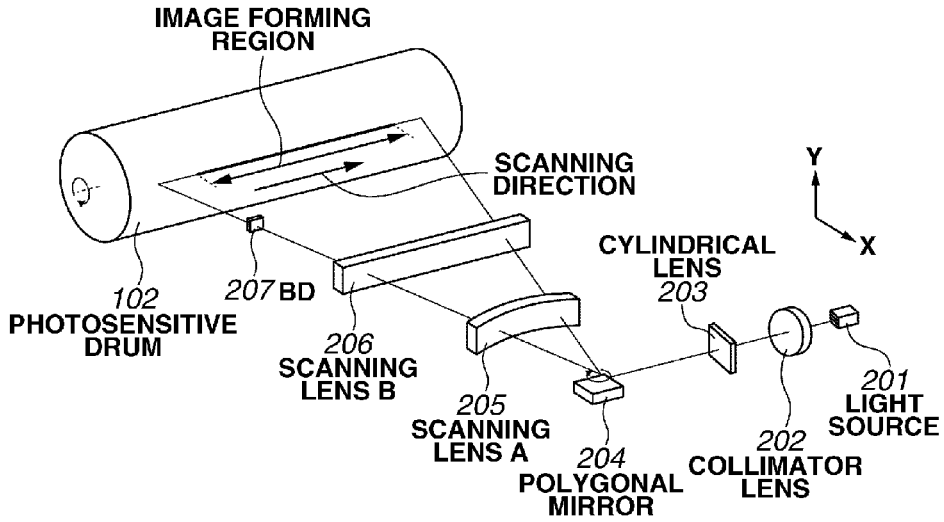
FIG. 2A schematically illustrates an internal configuration of an optical scanning device and a photosensitive drum.

FIG. 2A illustrates an exemplary embodiment of the optical scanning device 104. The optical scanning device 104 includes a light source 201 for emitting a laser light beam (a light beam), a collimator lens 202 for collimating the laser light beam into parallel light, a cylindrical lens 203 for collecting the laser light beam passing through the collimator lens 202 in the sub-scanning direction (a direction corresponding to a rotation direction of the photosensitive drum 102), and a polygonal mirror 204 (a rotating polygonal mirror). Further, the optical scanning device 104 includes an f-theta lens A205 (a scanning lens A, a first lens) and an f-theta lens B206 (a scanning lens B, a second lens) as a plurality of scanning lenses on which the laser light beam (scanning light) deflected by the polygonal mirror 204 is incident. Furthermore, the optical scanning device 104 includes a beam detector 207 (hereinbelow, referred to as the BD 207) which is a signal generation unit configured to detect the laser light beam deflected by the polygonal mirror 204 and output a horizontal synchronization signal according to the detection of the laser light beam. The laser light beam passing through the f-theta lens A205 and the f-theta lens B206 is incident on the BD 207. In a case where the optical performance is satisfied by a single scanning lens, the single scanning lens is provided to the optical scanning device 104.

Figure 2B:
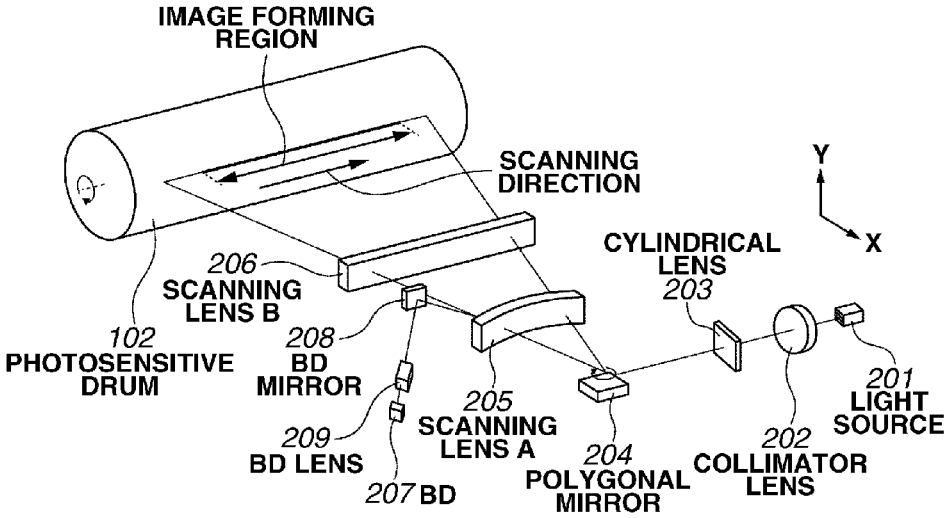
FIG. 2B schematically illustrates an internal configuration of an optical scanning device and a photosensitive drum.

FIG. 2B illustrates another exemplary embodiment of the optical scanning device 104. A difference between the optical scanning device 104 illustrated in FIG. 2A and the optical scanning device 104 illustrated in FIG. 2B is that, in the optical scanning device 104 illustrated in FIG. 2B, the laser light beam deflected by the polygonal mirror 204 passes through the f-theta lens A205, and the laser light beam reflected by a BD mirror 208 serving as a reflection mirror passes through a BD lens 209 and is incident on the BD 207. In other words, the laser light beam incident on the BD 207 does not pass through the f-theta lens B206. The BD lens 209 has an optical characteristic of collecting laser light beams to the BD 207, and the optical characteristic of the BD lens 209 is different from that of the f-theta lens B206.

Figure 3A:
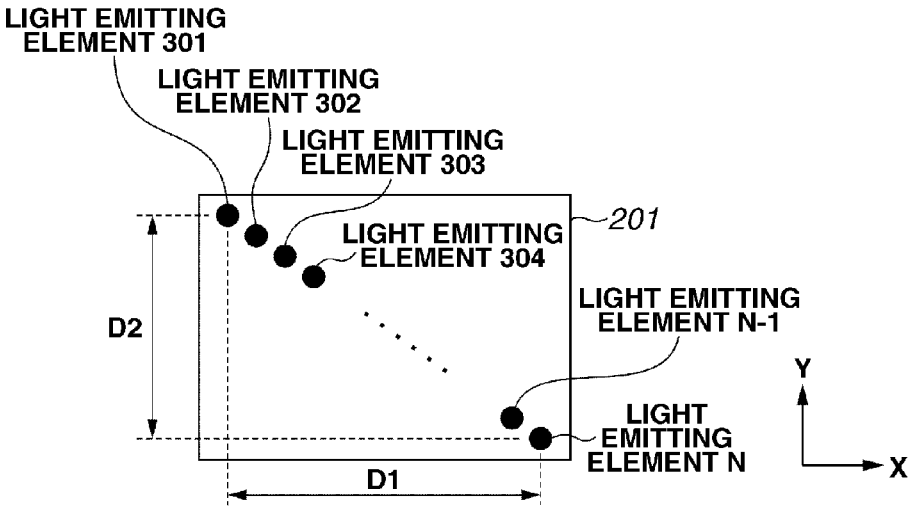
FIG. 3A schematically illustrates a light source.
Figure 3B:
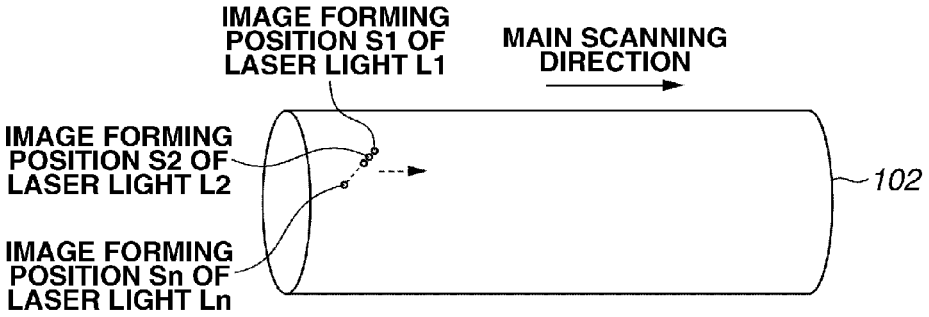
FIG. 3B illustrates a relative positional relationship among exposure positions of laser light beams on a photosensitive drum.

The light source 201 and the BD 207 will be described with reference to FIGS. 3A, 3B, and 3C. FIG. 3A is an enlarged view of the light source 201. The light source 201 includes N pieces of light emitting elements (a light emitting element 1 to a light emitting element N) that emit laser light beams. Laser light L1 (a first light beam) is emitted from the light emitting element 1 (a first light emitting element). Laser light L2 is emitted from the light emitting element 2. Laser light Ln is (a second light beam) is emitted from the light emitting element N (a second light emitting element). An X-axis direction illustrated in FIG. 3A corresponds to a direction in which a laser light beam deflected by the polygonal mirror 204 scans the surface of the photosensitive drum 102 (the main scanning direction). In addition, a Y-axis direction corresponds to the direction in which the photosensitive drum 102 rotates (the sub-scanning direction).

The plurality of light emitting elements 1 to N is arranged so as to form an array as illustrated in FIG. 3A. Since the light emitting elements 1 to N are arranged as illustrated in FIG. 3A, the laser light beam L1 to the laser light beam Ln emitted from the respective light emitting elements 1 to N form images at different positions on the photosensitive drum 102 in the main scanning direction. Further, the laser light beam L1 to the laser light beam Ln emitted from the respective light emitting elements 1 to N form images at different positions in the sub-scanning direction. The laser light beam L1 and the laser light beam Ln are laser light beams that expose the positions furthest away from each other in the main scanning direction and the sub-scanning direction. The arrangement of the plurality of light emitting elements 1 to N may be a two-dimensional arrangement.

A distance D1 illustrated in FIG. 3A is an interval (a distance) between the light emitting element 1 and the light emitting element N which are furthest away from each other in the X-axis direction. Since the light emitting element N among the plurality of light emitting elements is located furthest away from the light emitting element 1 in the X-axis direction, an image forming position Sn of the laser light beam Ln among the plurality of laser light beams is located furthest away from an image forming position S1 of the laser light beam L1 in the main scanning direction on the photosensitive drum 102 as illustrated in FIG. 3B. According to the present exemplary embodiment, the light emitting element 1 and the light emitting element N are disposed at the light source 201 in such a manner that the laser light beam L1 scans the photosensitive drum 102 before the laser light beam Ln scans the photosensitive drum 102. Due to this arrangement of the light emitting element 1 and the light emitting element N, the laser light beam L1 is incident on the BD 207, which will be described below, before the laser light beam Ln is incident on the BD 207.

A distance D2 illustrated in FIG. 3A is an interval (a distance) between the light emitting element 1 and the light emitting element N which are furthest away from each other in the Y-axis direction. Since the light emitting element 1 and the light emitting element N are furthest away from each other in the Y-axis direction, the image forming position Sn of the laser light beam Ln among the plurality of laser light beams is located furthest away from the image forming position S1 of the laser light beam L1 in the sub-scanning direction on the photosensitive drum 102 as illustrated in FIG. 3B.

A distance $Py=D2/N-1$ between the light emitting elements in the Y-axis direction is a distance corresponding to a resolution of the image forming apparatus (for example, the distance would be approximately 21 micrometers if the resolution is 1200 dpi). The distance Py is a value set by rotating and adjusting the light source 201 during an assembling process in such a manner that a distance between image forming positions of laser light beams adjacent to each other in the sub-scanning direction on the photosensitive drum 102 matches a distance corresponding to a predetermined resolution. A distance Px=D1/N−1 between the light emitting elements in the X-axis direction is a value unambiguously determined by adjusting the distance between the light emitting elements in the Y-axis direction to the distance Py. The timing at which a laser light beam is emitted from each light emitting element after a synchronization signal is generated by the BD 207 is set for each light emitting element during the assembling process with use of a predetermined tool, and is stored as an initial value in a memory, which will be described below. The initial value is a value corresponding to the distance Px.

FIG. 3C schematically illustrates the BD 207. The BD 207 includes a light receiving surface 207*a* on which photoelectric conversion elements are arranged. Laser light is incident on the light receiving surface 207*a*, by which a synchronization signal is generated. The BD 207 according to the present exemplary embodiment generates a plurality of BD signals corresponding to the respective laser light beams L1 to Ln according to entries of the laser light beam L1 and the laser light beam Ln into the BD 207.

The width of the light receiving surface 207*a* in the main scanning direction is set to a width D3, and the width of the light receiving surface 207*a* in a direction corresponding to the sub-scanning direction is set to a width D4. As illustrated in FIG. 3C, the laser light beam L1 emitted from the light emitting element 1 and the laser light beam Ln emitted from the light emitting element N scan the light receiving surface 207*a* of the BD 207. The width D4 of the light receiving surface 207*a* in the direction corresponding to the sub-scanning direction is set so as to satisfy D4>D2*alpha (alpha: a rate of variation in the distance between the laser light beam L1 and the laser light beam Ln passing through the lenses in the sub-scanning direction). The width D3 of the light receiving surface 207*a* in the main scanning direction is set so as to satisfy D3<D1*beta (beta: a rate of variation in the distance between the laser light beam L1 and the laser light beam Ln passing through the lenses in the main scanning direction), to prevent the laser light beam L1 and the laser light beam Ln from being incident on the light receiving surface 207*a* at the same time even when the light emitting element 1 and the light emitting element N are turned on at the same time.

Figure 4:
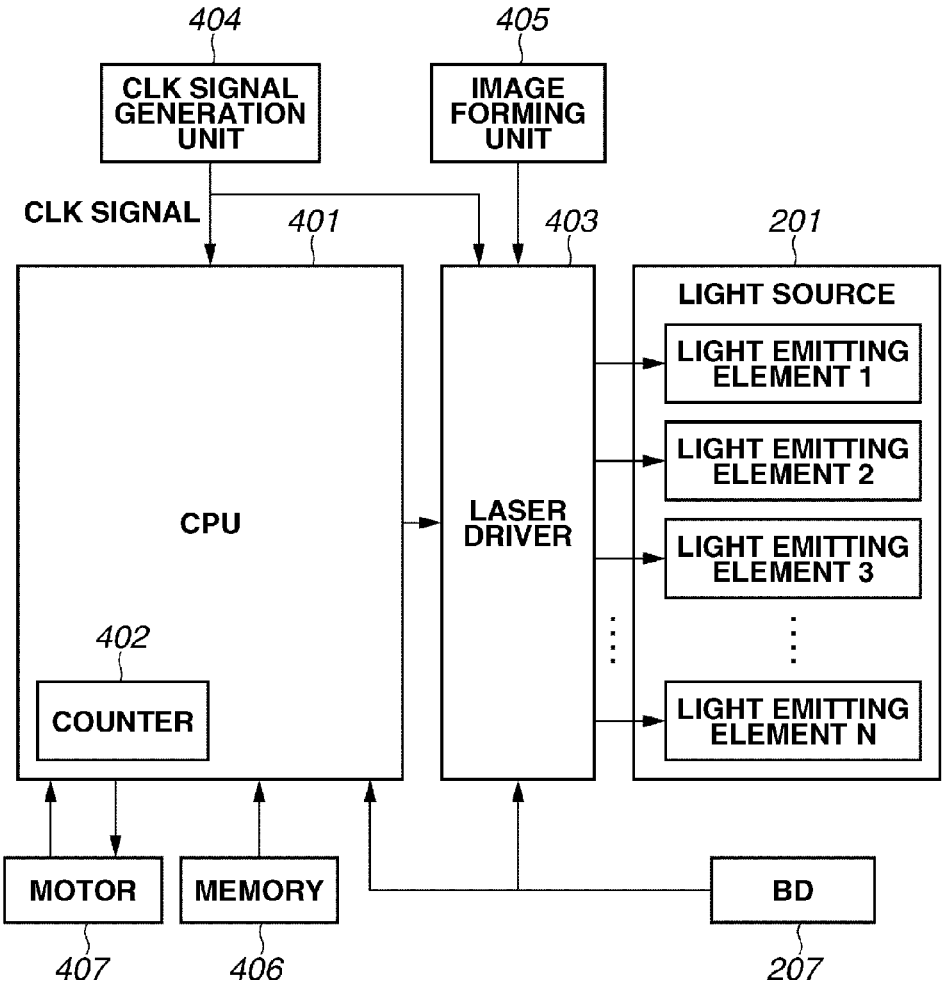
FIG. 4 is a control block diagram of the image forming apparatus according to an exemplary embodiment of the present invention.

FIG. 4 is a control block diagram of the image forming apparatus 100 according to the present exemplary embodiment. The image forming apparatus 100 according to the present exemplary embodiment includes a CPU 401, a counter 402, and a laser driver 403. The image forming apparatus 100 according to the present exemplary embodiment further includes a clock signal generation unit (a CLK signal generation unit) 404, an image processing unit 405, a memory 406, and a motor 407 for rotationally driving the polygonal mirror 204. The CPU 401 controls the image forming apparatus 100 according to a control program stored in the memory 406. The CLK signal generation unit 404 generates a clock signal (a CLK signal) of a predetermined frequency which is higher frequency than an output from the BD 207, and outputs the clock signal to the CPU 401 and the laser driver 403. The CPU 401 transmits a control signal to each of the laser driver 403 and the motor 407 in synchronization with the clock signal.

The motor 407 includes a speed sensor (not illustrated). The speed sensor employs a frequency generator (FG) method, according to which, the speed sensor generates a frequency signal proportional to a rotational speed. An FG signal of a frequency corresponding to the rotational speed of the polygonal mirror 204 is output from the motor 407 to the CPU 401. The counter 402 serving as a counting unit is disposed within the CPU 401. The counter 402 counts clock signals input to the CPU 401. The CPU 401 measures a cycle of generation of the FG signal based on the count value of the counter 402, and determines that the rotational speed of the polygonal mirror 204 reaches a predetermined speed if the cycle of generation of the FG signal is a predetermined cycle.

A BD signal output from the BD 207 is input to the CPU 401. The CPU 401 transmits a control signal for controlling the timing at which the laser light beam is emitted from each of the light emitting elements 1 to N to the laser driver 403 based on the input BD signal. Image data output from the image processing unit 405 is input to the laser driver 403. The laser driver 403 supplies a driving current based on the image data to each of the light emitting elements 1 to N at the timing based on the control signal transmitted from the CPU 401.

Figure 7A:
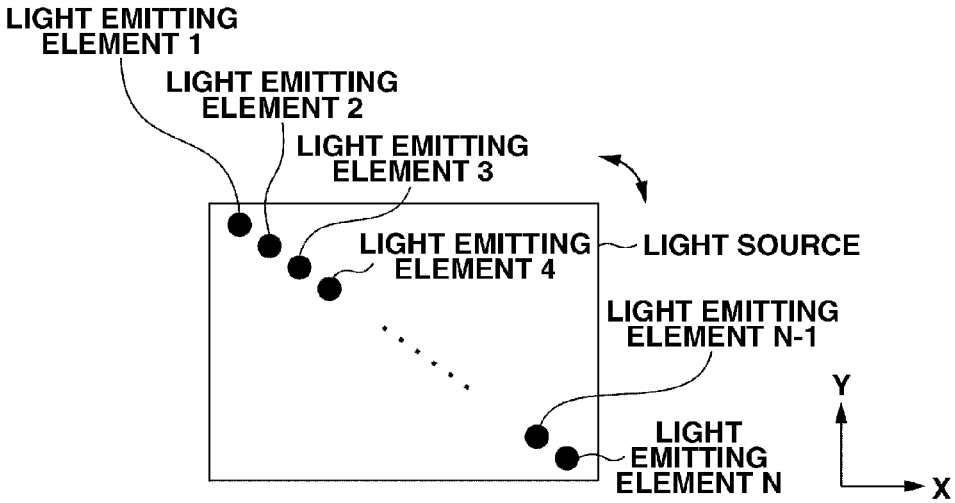
FIG. 7A illustrates an issue with a conventional image forming apparatus.
Figure 7B:
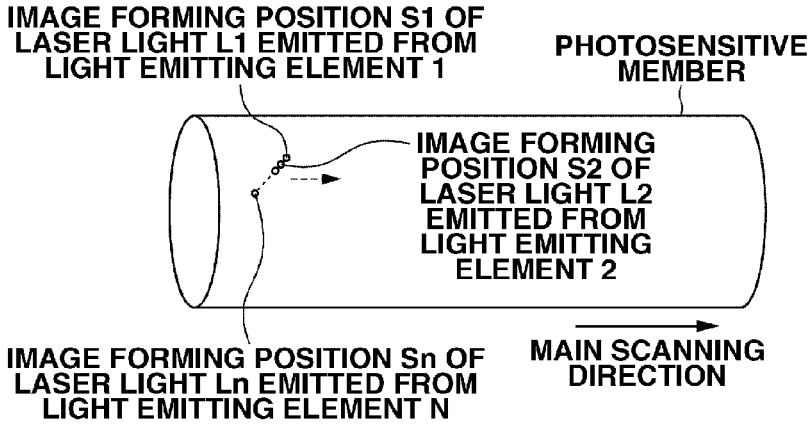
FIG. 7B illustrates an issue with a conventional image forming apparatus.

As illustrated in FIG. 7B, the image forming positions S1 to Sn of the respective laser light beams L1 to Ln are different in the main scanning direction. In the case of conventional image forming apparatuses, a laser light beam is emitted from a certain single light emitting element to generate a single BD signal. Then, a laser light beam is emitted from each of the light emitting elements based on a light beam emission timing (a fixed set value) set for each of the plurality of light emitting elements based on the generated BD signal, so that write start positions of electrostatic latent images (images) are matched in the main scanning direction.

Figure 7C:
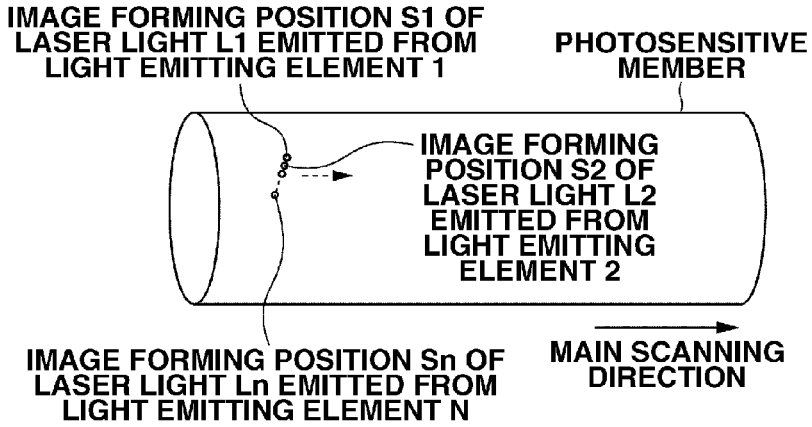
FIG. 7C illustrates an issue with a conventional image forming apparatus.

If the relative positional relationship among the image forming positions S1 to Sn is constant at all times during image formation, it is possible to match the image write start positions with each other even if the timing at which each of the light emitting elements 1 to N emits a laser light beam is controlled based on the fixed set value set for each of the light emitting elements 1 to N. However, emission of laser light beam causes an increase in the temperature of the light source, and the increase in the temperature of the light source 201 causes a change in the wavelength of the laser light beam emitted from each of the light emitting elements. Further, a rotation of the polygonal mirror 204 causes an increase in the temperature of the motor 407, and the optical characteristics of the scanning lenses change due to the influence of the heat. As illustrated in FIGS. 7B and 7C, these changes in the wavelength of the laser light beam and the optical characteristics of the scanning lenses lead to a change in the optical path of the laser light beam emitted from each of the light emitting elements, and therefore a change in the relative positional relationship among the image forming positions S1 to Sn. In other words, a change occurs in the layout of the exposure positions on the photosensitive drum 102. This results in occurrence of an issue of misalignment among write start positions of electrostatic latent images formed by the respective laser light beams in the main scanning direction.

Therefore, the image forming apparatus 100 according to the present exemplary embodiment generates two BD signals by the laser light beam L1 emitted from the light emitting element 1 and the laser light beam Ln emitted from the light emitting element N. The CPU 401 controls relative timings at which the plurality of light emitting elements emit the laser light beams based on a difference between timings at which the two BD signals are generated (a detection timing difference). This control will be described in detail below. The image forming apparatus 100 according to the present exemplary embodiment will be described based on an example that generates the BD signals by the laser light beam L1 and the laser light beam Ln which expose the positions furthest away from each other on the photosensitive drum 102 in the main scanning direction and the sub-scanning direction. However, the present exemplary embodiment is not limited thereto. The BD signals may be generated by a combination of the laser light beam L1 and the laser light beam Ln−1, a combination of the laser light beam L2 and the laser light beam Ln, or a combination of the laser light beam L2 and the laser light beam Ln−1. However, in order to detect a change in the characteristics of the lenses, it is desirable to generate a plurality of BD signals by each of a plurality of laser light beams away from an optical axis of the lenses at opposite sides from each other in the sub-scanning direction.

Figure 5:
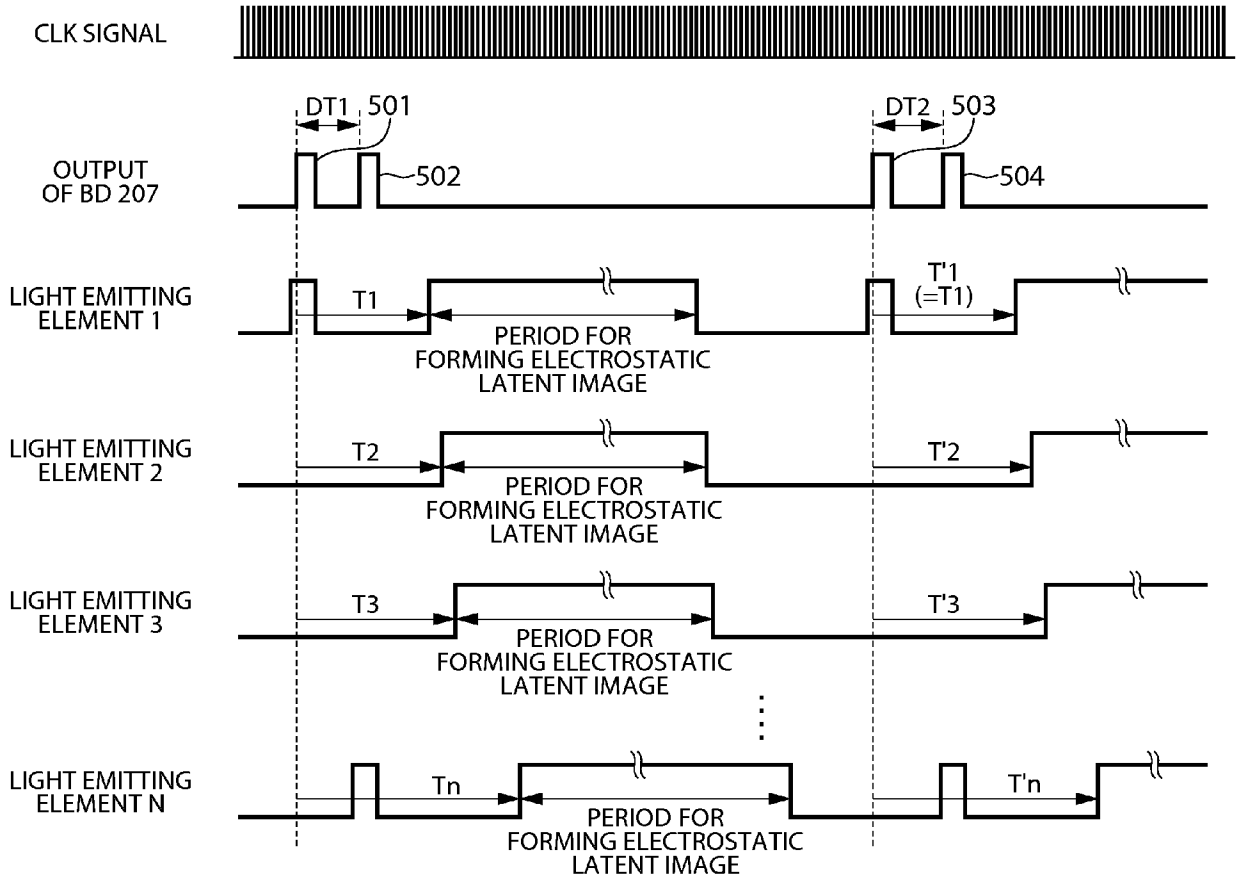
FIG. 5 is a timing chart indicating timings during one scanning cycle according to the exemplary embodiment of the present invention.

FIG. 5 is a timing chart illustrating timings at which the light emitting elements 1 to N emit the laser light beams L1 to Ln, and timings at which the BD 207 outputs BD signals. The first row indicates CLK signals. The second row indicates timings at which the BD 207 outputs BD signals. The third to sixth rows indicate timings at which the light emitting elements 1, 2, 3, and N output the laser light beams L1, L2, L3, and Ln.

During one scanning cycle of the laser light beam, first, the CPU 401 controls the laser driver 403 in such a manner that the light emitting element 1 and the light emitting element N emit the laser light beams L1 and Ln. Accordingly, as illustrated in FIG. 5, the BD 207 outputs a BD signal 501 according to detection of the laser light beam L1, and outputs a BD signal 502 according to detection of the laser light beam Ln. The CPU 401 starts counting CLK signals according to an input of the BD signal 501, and obtains a count value Ca according to an input of the BD signal 502. The count value Ca is detection data that indicates a difference DT1 between timings at which the BD signal 501 and the BD signal 502 are generated illustrated in FIG. 5.

Reference count value data Cref and count values C1 to Cn corresponding to the data Cref are stored in the memory 406. The reference count value data Cref is reference data (predetermined data) corresponding to a difference Tref between generation timings at which a plurality of BD signals is generated in a certain arbitrary condition. In the present example, the reference count value data Cref is defined to correspond to a difference between generation timings at which a plurality of BD signals is generated in the above-described initial condition. Each of the count values C1 to Cn is a count value (write start timing data) for matching the write start positions of the respective light emitting elements 1 to N in the main scanning direction, in a case where a difference between generation timings at which the plurality of BD signals is generated is the difference Tref. The count values C1 to Cn correspond to times T1 to Tn illustrated in FIG. 5, respectively.

The CPU 401 compares the count value Ca corresponding to the difference DT1 between the timings at which the BD signals 501 and 502 are generated, with the reference count value data Cref. If the comparison result is Ca=Cref, the CPU 401 turns on the light emitting element 1 in response to that the count value of the CLK signals from the generation of the BD signal 501 reaches the count value C1 (the time T1 has elapsed). In other words, as illustrated in FIG. 5, a period during which the light emitting element 1 forms an electrostatic latent image starts in response to that the count value of the CLK signals from the generation of the BD signal 501 reaches the count value C1 (the time T1 has elapsed). Further, the CPU 401 turns on the light emitting element N in response to that the count value of the CLK signals from the generation of the BD signal 501 reaches the count value Cn (the time Tn has elapsed). In other words, as illustrated in FIG. 5, a period during which the light emitting element N forms an electrostatic latent image starts in response to that the count value of the CLK signals from the generation of the BD signal 501 reaches the count value Cn (the time Tn has elapsed). Accordingly, the write start position of the electrostatic latent image (the image) formed by the light emitting element 1 can be matched with the write start position of the electrostatic latent image (the image) formed by the light emitting element N in the main scanning direction.

According to the present exemplary embodiment, the laser light emission timing of each of the light emitting elements 1 to N is controlled based on the BD signal generated by the laser light beam L1. However, the laser light emission timing of each of the light emitting elements 1 to N may be controlled based on the BD signal generated by the laser light beam Ln. Further, the laser light emission timing of each of the light emitting elements 1 to N may be controlled based on an arbitrary timing determined based on a plurality of BD signals generated by the laser light beam L1 and the laser light beam Ln.

Next, a method for determining the reference count value data Cref will be described. First, at the time of adjustment at a factory, the laser light beam L1 and the laser light beam Ln deflected by the rotating polygonal mirror 204 are incident on the BD 207 at the respective timings when the polygonal mirror 204 continues rotating in such a state that the temperature of the light source 201 is a reference temperature (for example, 25 degrees Celsius). Then, a difference DTref between timings at which a BD signal generated by the laser light beam L1 and a BD signal generated by the laser light beam Ln are detected is input into a measurement device. CLK signals are input from the CLK signal generation unit 404 to the measurement device, and the measurement device converts the detection timing difference DTref to a count value. The measurement device determines this count value as the reference count value data Cref, and stores it into the memory 406.

Further, at the time of the adjustment, a light receiving device is disposed at a position corresponding to a write start position of an electrostatic latent image on the surface of the photosensitive drum 102. The light receiving device receives the laser light beam L1 and the laser light beam Ln deflected by the polygonal mirror 204. The light receiving device transmits light reception signals indicating a timing at which the laser light beam L1 is received and a timing at which the laser light beam Ln is received, to the measurement device.

The measurement device converts a difference between the timing at which the BD signal is generated by the laser light beam L1 and the timing at which the light reception signal is generated in response to that the light receiving device receives the laser light beam L1, into a count value. This count value is set as the count value C1, and the measurement device stores the count value C1 into the memory 406 by associating with the reference count value data Cref. On the other hand, the measurement device converts a difference between the timing at which the BD signal is generated by the laser light beam L1 and the timing at which the light reception signal is generated in response to that the light receiving device receives the laser light beam Ln, into a count value. This count value is set as the count value Cn, and the measurement device stores the count value Cn into the memory 406 by associating with the reference count value data Cref. The measurement device stores the count values C1 to Cn into the memory 406 by performing the above-described processing on the respective light emitting elements 1 to N at the time of the adjustment.

Figure 3B:
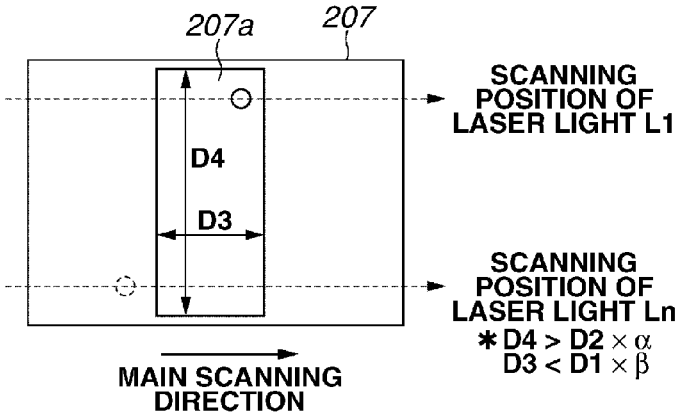

The present exemplary embodiment may be configured in such a manner that the count values C1 and Cn are stored in the memory 406, but the write start timing data for a light emitting element M (the light emitting element 2 to the light emitting element N−1) which is located between the light emitting element 1 and the light emitting element N in the X-axis direction in FIG. 3 is not stored in the memory 406. In this case, the CPU 401 calculates the write start timing data for the light emitting element M based on the count values C1 and Cn, and an arranged position of the light emitting element M relative to the light emitting elements 1 and N in the X-axis direction. In other words, the CPU 401 calculates the write start timing data Cm (a count value) for the light emitting element M located between the light emitting element 1 and the light emitting element N based on the following equation 1.

$$Cm = (Cn - C1) * (m - 1)/(n - 1) + C1 = C1 * (n - m)/(n - 1) + Cn * (m - 1)/(n - 1) \quad \text{(EQUATION 1)}$$

For example, in a case where the light source 201 includes four light emitting elements 1 to 4, the CPU 401 calculates write start timing data C2 for the light emitting element 2 and write start timing data C3 for the light emitting element 3 based on the following equation.

$$C2 = C1 + (C4 - C1) * 1/3 = C1 * 2/3 + C4 * 1/3 \quad \text{(EQUATION 2)}$$

$$C3 = C1 + (C4 - C1) * 2/3 = C1 * 1/3 + C4 * 2/3 \quad \text{(EQUATION 3)}$$

Next, when a difference between timings at which a BD signal 503 and a BD signal 504 are generated is a difference DT2, how the CPU 401 performs control will be described. As illustrated in FIG. 5, the BD 207 outputs the BD signal 503 according to detection of the laser light beam L1, and outputs the BD signal 504 according to detection of the laser light beam Ln. The CPU 401 detects a difference DT'1 between the timings at which the BD signal 503 and the BD signal 504 are generated as illustrated in FIG. 5, as a count value C'a. The CPU 401 compares the count value C'a and the reference count value data Cref. At this time, an example in which the count value C'a is equal to the reference count value data Cref (C'a=Cref) will be described. The CPU 401 corrects the write start timing data Cn based on a difference between the count value C'a and the reference count value data Cref to calculate C'n.

$$C'n = Cn * K(Cref - C'a) \quad \text{(EQUATION 4)}$$

(K is an arbitrary coefficient including 1)

The CPU 401 turns on the light emitting element N in response to that the count value of the counter 402 from the generation of the BD signal 503 reaches the corrected write start timing data C'n. Even if a change occurs in the difference between the timings at which the BD signals are generated, it is possible to match the write start position of an image formed by the light emitting element 1 and the write start position of an image formed by the light emitting element N in the main scanning direction.

The coefficient K is a coefficient multiplied to a change amount (Cref−C'a) in the time interval on the BD 207 (on the light receiving surface 207*a*), and is determined by measuring the optical characteristics of the lenses provided to the optical scanning device 104 at the time of the above-described adjustment at the factory. In the optical scanning device 104 illustrated in FIG. 2A, the laser light beam L1 and the laser light beam Ln incident on the BD 207, and the laser light beams L1 to Ln reaching the photosensitive drum 102 pass through the same lenses. Therefore, the detection timing difference DTref measured by the measurement device at the time of the adjustment, and the light reception timing difference between the laser light beam L1 and the laser light beam Ln received by the light receiving device are substantially the same. Therefore, the coefficient K is set to one (K=1) for the optical scanning device 104 illustrated in FIG. 2A.

On the other hand, in the optical scanning device 104 illustrated in FIG. 2B, while the laser light beam L1 and the laser light beam Ln incident on the BD 207 pass through the scanning lens A205 and the BD lens 209, the laser light beams L1 to Ln reaching the photosensitive drum 102 pass through the scanning lens A205 and the scanning lens B206. In other words, the laser light beam L1 and the laser light beam Ln incident on the BD 207, and the laser light beams L1 to Ln reaching the photosensitive drum 102 pass through different lenses. Therefore, the speed at which the laser light beam L1 and the laser light beam Ln scan the BD 207 is different from the speed at which the laser light beams L1 to Ln scan the photosensitive drum 102. In such an optical scanning device, the coefficient K is set to a positive value other than 1, based on the detection timing difference DTref measured by the measurement device at the time of the adjustment, and the light reception timing difference between the laser light beam L1 and the laser light beam Ln received by the light receiving device. In a case where the optical scanning device 104 includes a single scanning lens, the BD 207 may be configured so as to receive laser light passing through the single scanning lens, or may be configured so as to receive laser light that does not pass through the scanning lens.

Figure 6:
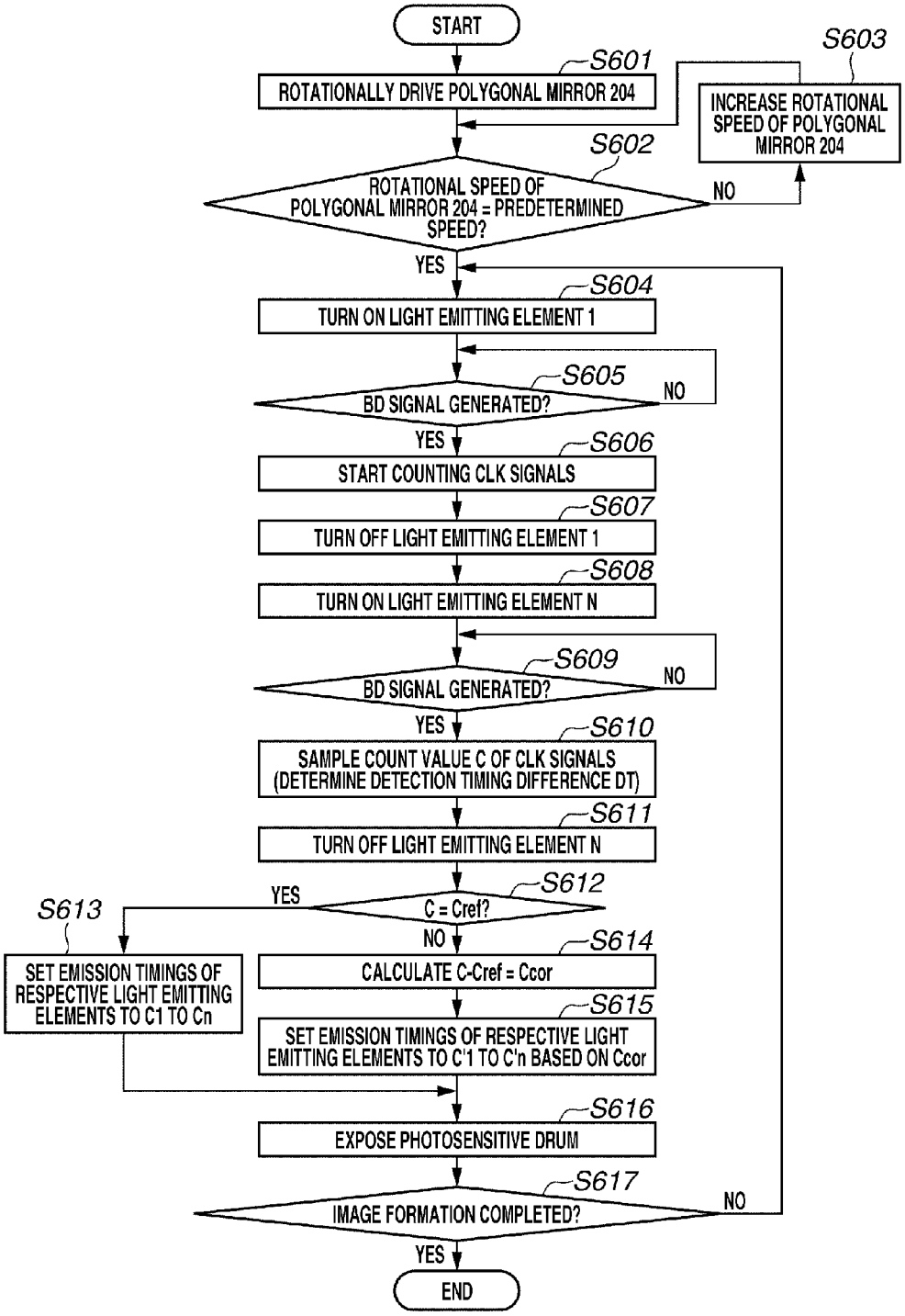
FIG. 6 is a flowchart illustrating a control flow executed by a central processing unit (CPU) provided to the image forming apparatus according to the exemplary embodiment of the present invention.

Next, a flow of control executed by the CPU 401 will be described with reference to FIG. 6. This control starts according to an input of image data into the image forming apparatus 100. First, in step S601, the CPU 401 causes the polygonal mirror 204 to rotate by driving the motor 407 according to the input of the image data. Subsequently, in step S602, the CPU 401 determines whether the rotational speed of the polygonal mirror 204 reaches a predetermined rotational speed. If the CPU 401 determines in step S602 that the rotational speed of the polygonal mirror 204 does not reach the predetermined rotational speed (NO in step S602), in step S603, the CPU 401 increases the rotational speed of the polygonal mirror 204, and returns the control to step S602.

If the CPU 401 determines in step S602 that the rotational speed of the polygonal mirror 204 reaches the predetermined rotational speed (YES in step S602), in step S604, the CPU 401 turns on the light emitting element 1. Subsequently, in step S605, the CPU 401 determines whether a BD signal is generated by the laser light beam L1 emitted from the light emitting element 1. If the CPU 401 determines in step S605 that a BD signal is not generated by the laser light beam L1 (NO in step S605), the CPU 401 repeats the control in step S605 until the CPU 401 confirms that a BD signal is generated. On the other hand, if the CPU 401 determines in step S605 that a BD signal is generated by the laser light beam L1 (YES in step S605), in step S606, the CPU 401 causes the counter 402 to start counting CLK signals according to the generation of the BD signal.

After step S606, in step S607, the CPU 401 turns off the light emitting element 1. Then, in step S608, the CPU 401 turns on the light emitting element N. In step S609, the CPU 401 determines whether a BD signal is generated by the laser light beam Ln emitted from the light emitting element N. If the CPU 401 determines in step S609 that a BD signal is not generated by the laser light beam Ln (NO in step S609), the CPU 401 repeats the control in step S609 until the CPU 401 confirms that a BD signal is generated. On the other hand, if the CPU 401 determines in step S609 that a BD signal is generated by the laser light beam Ln (YES in step S609), in step S610, the CPU 401 samples the count value of CLK signals by the counter 402 according to the generation of the BD signal. Then, in step S611, the CPU 401 turns off the light emitting element N.

After step S611, in step S612, the CPU 401 compares a sampled count value C with the reference count value data Cref to determine whether the count value C is equal to the reference count value data Cref (C=Cref). If the CPU 401 determines that the count value C is equal to the reference count value data Cref (C=Cref) (YES in step S612), in step S613, the CPU 401 sets the laser light emission timing corresponding to the respective light emitting elements based on the BD signal generated by the laser light beam L1 from the count value C1 to the count value Cn. On the other hand, if the CPU 401 determines in step S612 that the count value C is not equal to the reference count value data Cref (C not equal Cref) (NO in step S612), in step S614, the CPU 401 calculates Ccor=C−Cref. Then, in step S615, the CPU 401 sets the laser light emission timing corresponding to the respective light emitting elements based on the BD signal generated by the laser light beam L1 from the count value C'a to the count value C'n based on the difference Ccor.

After step S613 or step S615, in step S616, the CPU 401 exposes the photosensitive drum 102 by causing the light source 201 to emit laser light beams based on the image data according to the laser light emission timings set in the respective steps. After step S616, in step S617, the CPU 401 determines whether the image formation is completed. If the CPU 401 determines that the image formation is not completed (NO in step S617), the CPU 401 returns the control to step S614. On the other hand, if the CPU 401 determines in step S617 that the image formation is completed (YES in step S617), the CPU 401 ends the control.

As described above, the image forming apparatus according to the present exemplary embodiment generates a plurality of BD signals by causing the light beams emitted from the different light emitting elements to enter to the BD during image formation, and controls the relative timings at which images start to be written by the respective light emitting elements in the main scanning direction based on the difference between the timings at which the plurality of BD signals is generated. Therefore, it is possible to prevent occurrence of a variation in the image write start positions during the image formation.

According to the present invention, it is possible to prevent occurrence of a variation in positions at which a plurality of light beams start writing electrostatic latent images during image formation.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims the benefit of Japanese Patent Application No. 2012-098682, filed Apr. 24, 2012, which is hereby incorporated by reference herein in its entirety.

REFERENCE SIGNS LIST

201 light source
207 BD
401 CPU
402 counter
403 laser driver
404 clock signal generation unit
406 memory

The invention claimed is:

1. An image forming apparatus comprising:

a photosensitive member configured to rotate;

an optical scanning device including a light source including a plurality of light emitting elements including a first light emitting element configured to emit a first light beam and a second light emitting element configured to emit a second light beam for exposing the photosensitive member, a deflection unit configured to deflect a plurality of light beams emitted from the light source to cause the plurality of light beams to scan the photosensitive member, a lens configured to guide the plurality of light beams deflected by the deflection unit to the photosensitive member, and a light receiving unit including a receiving surface on which the first light beam and the second light beam deflected by the deflection unit scan, configured to generate a first signal by the first light beam scanning the receiving surface, and configured to generate a second signal by the second light beam scanning the receiving surface, wherein the first light emitting element and the second light emitting element are disposed at the light source in such a manner that the first light beam and the second light beam expose different positions in a scanning direction in which the first light beam and the second light beam deflected by the deflection unit scan the photosensitive member, and the first light emitting element and the second light emitting element are disposed at the light source and the receiving surface has a width in a scanning direction in which the first light beam and the second light beam scan the receiving surface, in such a manner that the first light beam and the second light beam does not scan the receiving surface simultaneously;

a storage unit configured to store predetermined data, wherein the predetermined data to compare with a timing difference between the first signal and the second signal; and a control unit configured to control the light source so that the first light beam and the second light beam enter the receiving surface during a same scanning period of the plurality of light beams, determine a delay amount of the second beam emission timing based on an image data with respect to the first beam emission timing based on the image data based on a result of a comparison between the predetermined data and the timing difference between the first signal and the second signal, control the first beam emission start timing during one scanning period based on a first signal generated by the first light beam, and control the second light beam emission timing during one scanning period based on a first signal generated by the first light beam and the delay amount for matching an exposure start position of the first light beam and an exposure start position of the second light beam on the photosensitive member in the scanning direction.

2. The image forming apparatus according to claim 1, wherein the lens guides the plurality of light beams deflected by the deflection unit to the photosensitive member, wherein the predetermined data is data generated based on a characteristic of the lens, and wherein the light receiving unit receives the first light beam and the second light beam passing through the lens.

3. The image forming apparatus according to claim 1, wherein the lens includes a plurality of lenses configured to guide the plurality of light beams deflected by the deflection unit to the photosensitive member, wherein the predetermined data is data generated based on characteristics of the plurality of lenses, and wherein the light receiving unit receives the first light beam and the second light beam passing through the plurality of lenses.

4. The image forming apparatus according to claim 1, wherein the lens includes a first lens on which the plurality of light beams deflected by the deflection unit is incident, and a second lens configured to guide the plurality of light beams passing through the first lens to the photosensitive member, wherein the predetermined data is data generated based on a characteristic of the first lens, and wherein the light receiving unit receives the first light beam and the second light beam that pass through the first lens but do not pass through the second lens.

5. The image forming apparatus according to claim 1, wherein the first light emitting element and the second light emitting element are arranged in such a manner that the first light beam and the second light beam expose different positions from each other on the photosensitive member in a rotational direction of the photosensitive member which intersects with the scanning direction.

6. The image forming apparatus according to claim 5, wherein the plurality of light emitting elements including the first light emitting element and the second light emitting element is arranged in such a manner that the first light beam and the second light beam among the plurality of light beams emitted from the plurality of light emitting elements expose positions furthest away from each other in the rotational direction of the photosensitive member.

7. The image forming apparatus according to claim 1, wherein the light source includes a third light emitting element configured to emit a third light beam and disposed relative to the first light emitting element and the second light emitting element in such a manner that an exposure position of the third light beam on the photosensitive member is positioned between an exposure position of the first light beam and an exposure position of the second light beam in the scanning direction, and wherein the control unit controls a timing at which the third light emitting element emits the third light beam for forming an electrostatic latent image on the photosensitive member, based on the timing at which the first light emitting element emits the first light beam for forming the electrostatic latent image on the photosensitive member, the timing at which the second light emitting element emits the second light beam for forming the electrostatic latent image on the photosensitive member, and a position where the third light emitting element is disposed relative to the first light emitting element and the second light emitting element.

8. The image forming apparatus according to claim 1, further comprising:

a signal generation unit configured to generate a clock signal; and a counting unit configured to count the clock signal, wherein the first light emitting element and the second light emitting element are disposed at the light source in such a manner that the first light beam scans the photosensitive member prior to the second light beam in the scanning direction, and wherein the control unit causes the counting unit to start counting the clock signal according to detection of the first light beam by the light receiving unit, and obtains a count value of the counting unit according to detection of the second light beam by the light receiving unit, thereby obtaining the detection timing difference.

9. The image forming apparatus according to claim 1, wherein the control unit controls timings at which the plurality of light emitting elements emits the light beams for forming electrostatic latent images on the photosensitive member based on a timing at which the light receiving unit receives the first light beam.

10. The image forming apparatus according to claim 1, wherein the control unit controls timings at which the plurality of light emitting elements emits the light beams for forming electrostatic latent images on the photosensitive member based on a timing at which the light receiving unit receives the second light beam.

11. The image forming apparatus according to claim 1, wherein the light source includes three or more light emitting elements, and wherein an exposure position of the first light beam and an exposure position of the second light beam are positioned furthest away from each other in the scanning direction, among exposure positions of light beams respectively emitted from the plurality of light emitting elements.

12. The image forming apparatus according to claim 1, wherein the control unit is configured to execute a sequence for determining the delay amount according to input of image data, wherein the sequence includes a rotational controlling step to control the deflection unit to rotate at a predetermined rotational speed, an incident step to cause the first light beam and the second light beam to enter to the receiving surface in a state where the deflection unit rotating at the predetermined rotational speed, and a calculation step to calculate the delay amount based on the light receiving result on the receiving surface obtained at the incident step, wherein the control unit executes an image forming process based on the input image data after executing the sequence.

* * * * *